US007410169B2

(12) United States Patent
Uchiyama et al.

(10) Patent No.: US 7,410,169 B2
(45) Date of Patent: Aug. 12, 2008

(54) RANDOM NUMBER SELECTOR, AND BINGO GAME MACHINE INCORPORATING THE SAME

(75) Inventors: Takashi Uchiyama, Tokyo (JP); Nobuhiro Goto, Tokyo (JP); Shingo Yasuda, Tokyo (JP)

(73) Assignee: Konami Corporation, Tokyo (JP)

( * ) Notice: Subject to any disclaimer, the term of this patent is extended or adjusted under 35 U.S.C. 154(b) by 702 days.

(21) Appl. No.: 10/526,774

(22) PCT Filed: Aug. 29, 2003

(86) PCT No.: PCT/JP03/11115

§ 371 (c)(1),
(2), (4) Date: Mar. 8, 2005

(87) PCT Pub. No.: WO2004/023400

PCT Pub. Date: Mar. 18, 2004

(65) Prior Publication Data

US 2006/0012117 A1 Jan. 19, 2006

(30) Foreign Application Priority Data

Sep. 9, 2002 (JP) ..... 2002-263255

(51) Int. Cl.
*A63B 71/00* (2006.01)

(52) U.S. Cl. ..... 273/142 R; 273/142 E

(58) Field of Classification Search ..... None
See application file for complete search history.

(56) References Cited

U.S. PATENT DOCUMENTS

| | | | | |
|---|---|---|---|---|
| 3,853,324 | A * | 12/1974 | Reiner et al. | 273/142 E |
| 5,553,851 | A * | 9/1996 | Malavazos et al. | 273/142 E |
| 5,755,440 | A | 5/1998 | Sher | |
| 6,164,647 | A | 12/2000 | Chee | |

FOREIGN PATENT DOCUMENTS

| | | | |
|---|---|---|---|
| FR | 2 752 745 | A | 3/1998 |
| GB | 951 144 | A | 3/1964 |
| GB | 2 363 733 | A | 1/2002 |
| JP | 49-82889 | | 7/1974 |
| JP | 2991093 | B2 | 10/1999 |
| JP | 2001-218906 | A | 8/2001 |

* cited by examiner

*Primary Examiner*—Ronald Laneau
*Assistant Examiner*—Tramar Harper
(74) *Attorney, Agent, or Firm*—Sughrue Mion, PLLC

(57) ABSTRACT

In a random number selector using a selection ball, a first selector is provided with a passage and a plurality first pockets each associated with a symbol and operable to receive the selection ball. A second selector is provided with a plurality of second pockets each associated with a jackpot and operable to receive the selection ball. A guide member guides the selection ball which has been passed through the passage in the first selector to the second selector. In a bingo game machine, a first bingo game using only the first selector and a second bingo game using both of the first selector and the second selector are performed.

8 Claims, 10 Drawing Sheets

RANDOM NUMBER SELECTOR, AND BINGO GAME MACHINE INCORPORATING THE SAME

TECHNICAL FIELD

The invention relates to a random number selector and a bingo game machine incorporating the same.

BACKGROUND ART

A conventional bingo game machine employs, e.g., a roulette-like random number selector, at the time of number selection (lottery). Bingo cards of respective players are displayed on a screen, and the random number selector conducts several times of lottery operations, thereby selecting, e.g., five numbers (or symbols). When any of the thus-selected numbers are present on the bingo cards, corresponding numbers on the bingo cards become valid. In some cases, bingo cards are provided with symbols "FREE" which yield the same effect as those attained by the numbers which have been selected and validated by the lottery. When a continuous line is established vertically, horizontally, or diagonally on the bingo card by the five numbers that have been made valid by the lottery or with an aid of the symbol "FREE," a BINGO is established, whereby a predetermined number of tokens are paid.

However, the conventional bingo game machine conducts a random number selection in a manner well known by the players. Hence, an impression of obsolescence of a bingo game has become stronger. Further, a game offered by the bingo game machine is achieved by merely performing a conventional bingo game, in which numbered balls are drawn by lottery and corresponding numbers on a card are opened. Therefore, providing a player a sense of amusement and excitement in the bingo game is not an easy task.

DISCLOSURE OF THE INVENTION

It is therefore an object of the invention to provide a random number selector capable of enhancing a player's interest and expectation by introducing a new lottery method into a bingo game.

It is also an object of the invention to provide a bingo game machine incorporating such a random number selector.

In order to achieve the above objects, according to the invention, there is provided a random number selector using a selection ball, comprising:

a first selector, provided with a passage and a plurality first pockets each associated with a symbol and operable to receive the selection ball;

a second selector, provided with a plurality of second pockets each associated with a jackpot and operable to receive the selection ball; and a guide member, which guides the selection ball which has been passed through the passage in the first selector to the second selector.

Preferably, the first selector and the second selector are coaxially and horizontally arranged while defining a space therebetween in which the guide member is disposed.

Here, it is preferable that the first selector and the second selector are rotatable independently.

It is also preferable that the guide member is vertically movable in the space between a first position operable to guide the selection ball which has been passed through the passage to the second selector and a second position operable to guide the selection ball which has been passed through the passage to a recovery port through which the selection ball is recovered to an initial position.

Preferably, the second selector is provided with a protrusion located between the second pockets.

According to the invention, there is also provided a bingo game machine, comprising:

the above random number selector; and a controller, operable to perform a first bingo game using only the first selector, and a second bingo game using both of the first selector and the second selector.

Preferably, the controller is operable to provide an additional selection ball used in the second bingo game to at least one player in a case where the at least one player satisfies a predetermined requirement in the first bingo game.

Here, it is preferable that: the controller is operable to control a virtual player who plays the first bingo game together with the at least one player; and the predetermined requirement is to win over the virtual player in the first bingo game.

It is further preferable that the bingo game machine further comprises: a first display, which displays a bingo card of the virtual player; and a plurality of second displays, each of which displays a bingo card of each player. Here, the second displays are located at viewpoints of the first display.

According to the above configurations, when the selection ball has entered any of the numbered first pockets during the first bingo game, corresponding numbers of the bingo cards are made valid. In a case where the selection ball has passed by the passage and the guide member is placed in the second position, the selection ball is recovered and again offered to the random number selection. Hence, the player' expectation can be maintained immediately before the numbers for a bingo are determined. For example, when the selection ball seems not to enter the first pocket desired by the player, the selection ball is again offered to the random number selection, so long as the ball has passed by the passage, thereby resulting in a chance of the selection ball entering the first pocket desired by the player. As a result, the player's expectation can be enhanced.

During the second bingo game, in a case where the selection ball has entered a numbered first pocket, a corresponding number of the bingo card is made valid. On the other hand, in a case where the selection ball has passed by the passage, the selection ball is guided to the second selector where the jackpot selection is conducted. Therefore, the player has a strong expectation for passage of the selection ball through the passage. If the selection ball has entered any of the second pockets, the dividend corresponding to the second pocket is afforded to the player. Therefore, the player's interest in the game can be enhanced.

BEST MODE FOR CARRYING OUT THE INVENTION

One preferred embodiment of the invention will be described below in detail with reference to the accompanying drawings.

Figure 1:
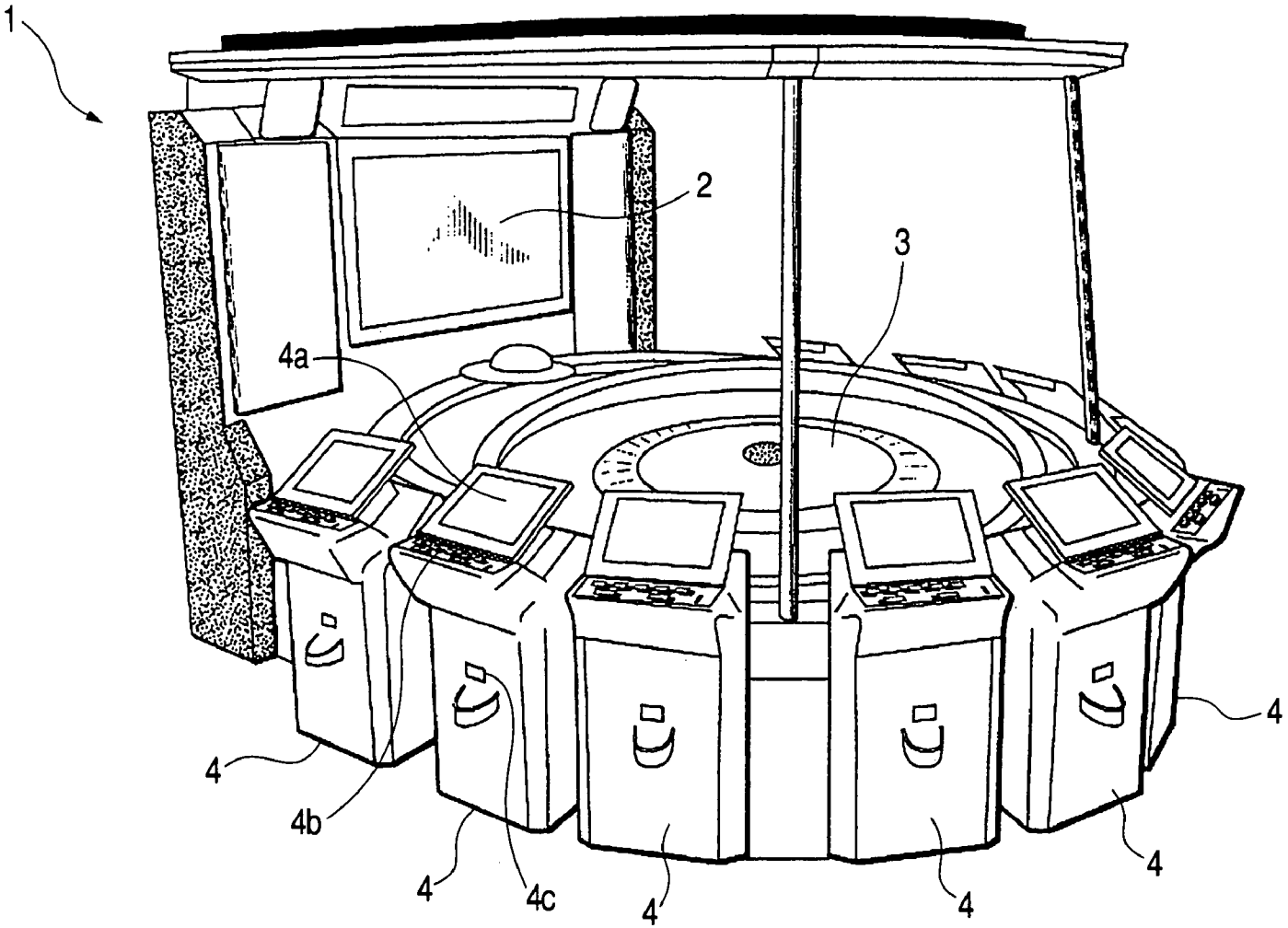
FIG. 1 is a view showing the appearance of a bingo game machine according to one embodiment of the invention.

As shown in FIG. 1, a bingo game machine 1 is equipped with a center display 2 constituted of a display device having sufficient display capability, such as a liquid-crystal panel, plasma display panel (PDP), or a projector (monitor projector). A random number selector 3 which physically conducts a lottery is disposed at the center of the bingo game machine 1. Here, "physically conducts" means that the random number selection is performed without involvement of control by a CPU or the like. In the embodiment, the random number selector 3 adopts a roulette system using balls.

Terminals 4 where a plurality of players are to play games are disposed around the random number selector 3. The embodiment uses ten terminals 4, to thereby enable ten players to participate in a bingo game. Each of the terminals 4 is equipped with a terminal display 4*a* constituted of a display device having sufficient display capability, such as a liquid-crystal panel or a PDP (plasma display panel), and an operating section 4*b* where the player performs operation pertaining to a game. A function of a touch panel may be added to the terminal display 4*a*, and operation buttons pertaining to main operation of a game may be performed by way of a touch panel. Further, a token payout port 4*c* having a receiver for receiving paid tokens is provided at a position below the operating section 4*b*.

Figure 2:
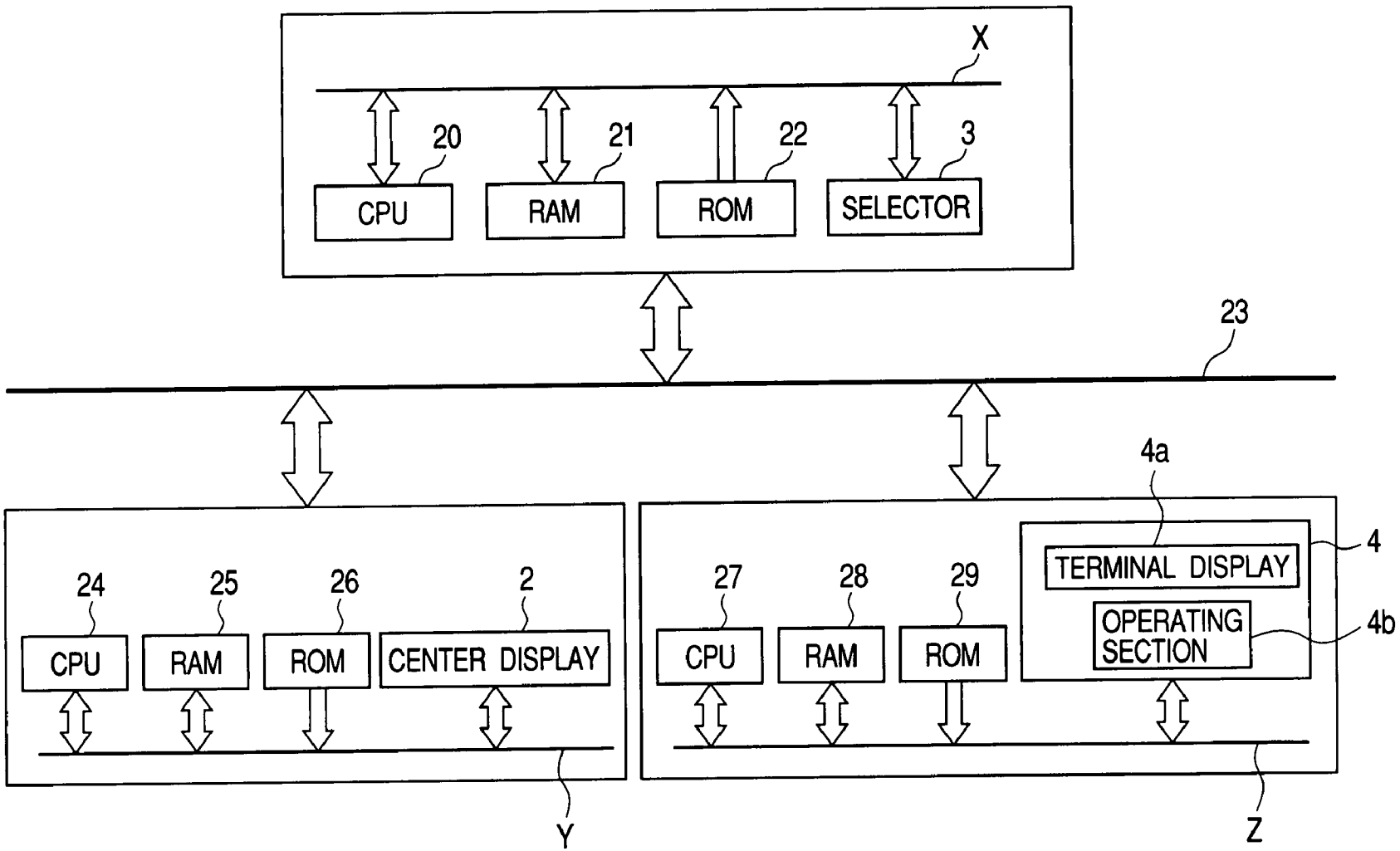
FIG. 2 is a view showing an electrical configuration of the bingo game machine.

As shown in FIG. 2, a CPU 20 executes a program stored in a ROM 22 through use of a RAM 21, thereby controlling the random number selector 3 by way of a control bus X. The center display 2, the random number selector 3, and the terminals 4 operate under control of the CPU 20. These elements communicate a signal by way of a control bus 23. A CPU 24 executes a program stored in a ROM 26 through use of a RAM 25, thereby controlling the center display 2 by way of a control bus Y. A CPU 27 executes a program stored in a ROM 29 through use of a RAM 28, thereby controlling the terminals 4 by way of a control bus 23. These CPUs exchange signals with each other by way of the control bus 23.

Figure 3:
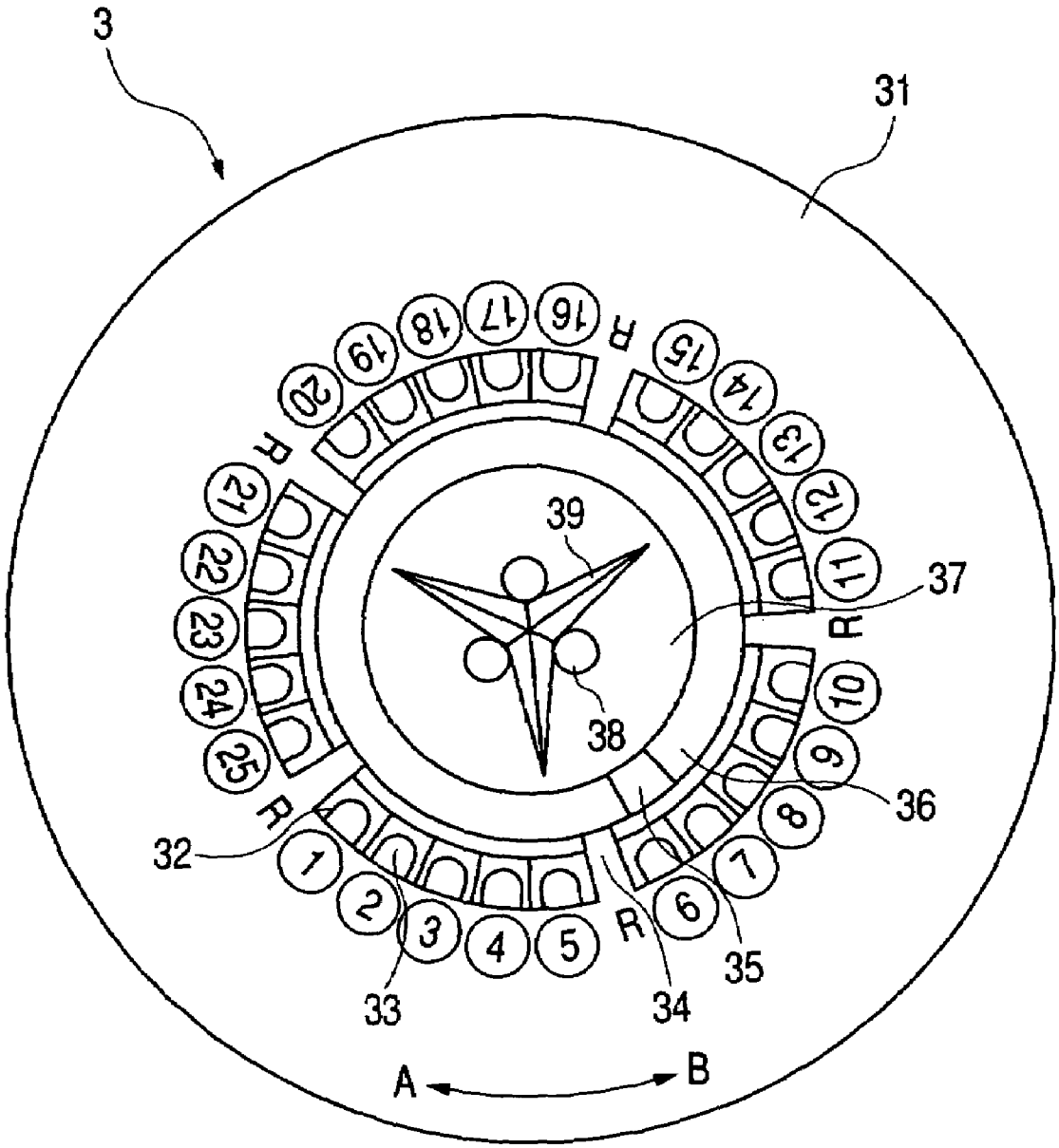
FIG. 3 is a plan view showing a random number selector of the bingo game machine.
Figure 4:
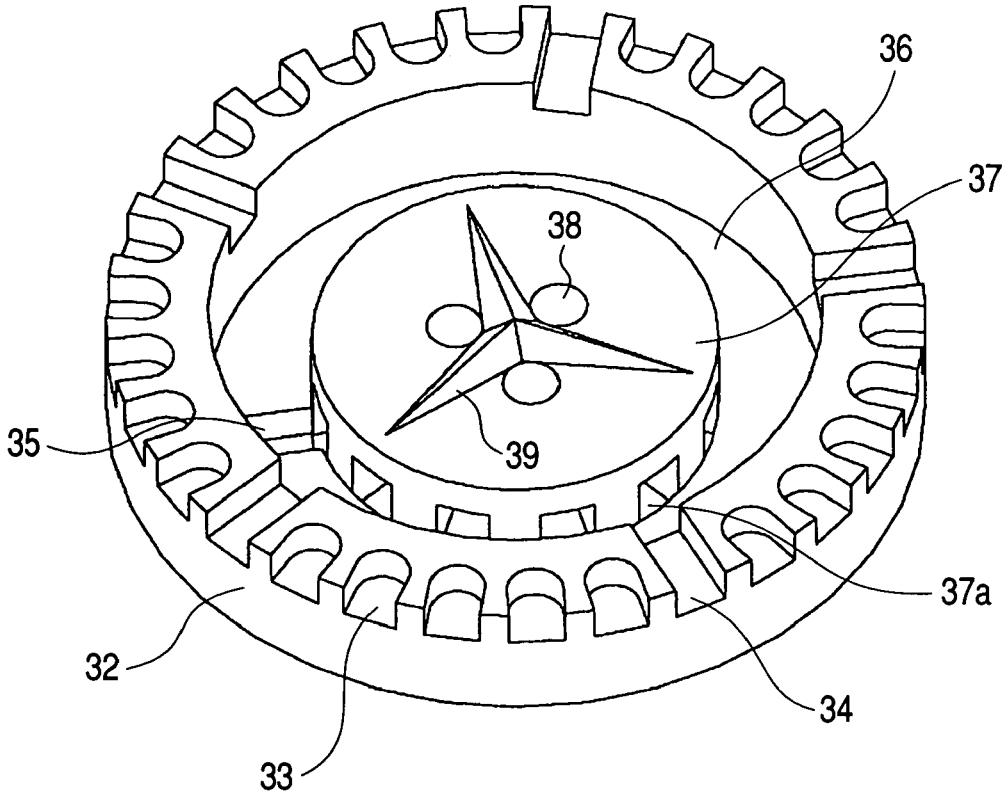
FIG. 4 is a perspective view showing a roulette section, a jackpot selector, and a guide member of the random number selector in a normal game state.
Figure 5:
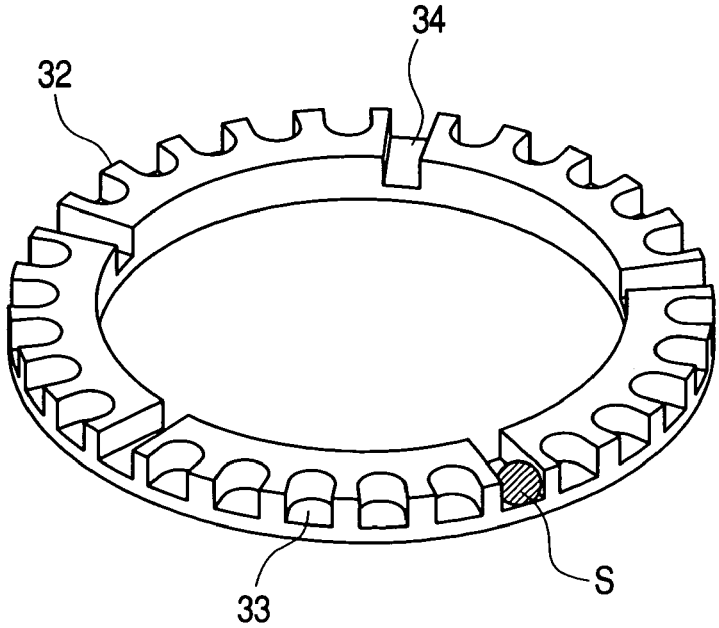
FIG. 5 is a perspective view showing the roulette section.

As shown in FIG. 3, the random number selector 3 has a field 31 and the roulette section 32, wherein the field 31 is formed from semi-translucent material into a hollow, hemispherical shape and a cast ball rolls over the field 31. The roulette section 32 spins in direction A or B in FIG. 3. As shown in FIGS. 4 and 5, total of twenty-five pockets 33 into which a selection ball S can enter are formed in the roulette section 32. The pockets 33 are separated into blocks, each block consisting of five pockets. A total of five first passages 34 are provided between the blocks for guiding the ball S from an outer peripheral side of the roulette section 32 to an inner peripheral side of the same.

Numbers 1 through 25 are assigned to the twenty-five pockets 33, respectively. As shown in FIG. 3, the numbers assigned to the respective pockets 33 appear in an area where the field 31 adjoins the roulette section 32. Further, letters "R" appear in portions of the area correspond to the first passages 34. Specifically, a display section is formed behind the field 31, whereby the "numbers" assigned to the pockets 33 and the letters "R" assigned to the first passages 34 are displayed by colored transparent material. The display section is lighted by a backlight. Therefore, the backlight passes through the display section that forms "numbers or letters R" and comes to the front of the field 31. The display section and the backlight are rotated behind the field 31 in conjunction with the roulette section 32. This configuration enables display of the "numbers and letters R" in the roulette section 32 with enhanced appearance. Further, the "numbers and letters R" appear in the field 31, and hence the ball will not block the "number or letter R" even when the ball has entered any pocket 33. The player can readily ascertain the number of the pocket which the ball has entered.

Figure 6:
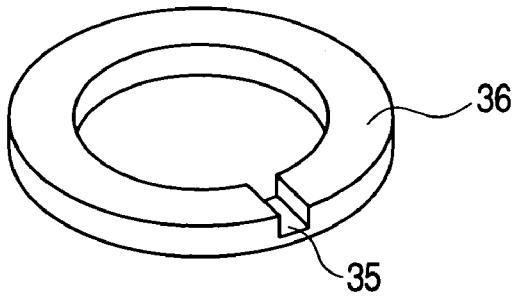
FIG. 6 is a perspective view showing the guide member.
Figure 7:
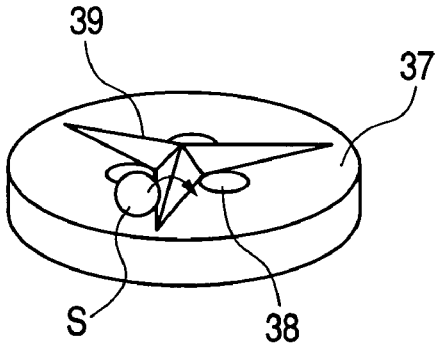
FIG. 7 is a perspective view showing the jackpot selector.

As shown in FIGS. 4 and 6, a guide member 36 having a second passage 35 for enabling passage of the ball S is provided at a position close to the inner periphery side of the roulette section 32. The guide member 36 is constituted so as to be able to move vertically at predetermined timings. Further, as shown in FIGS. 4 and 7, a jackpot selector 37 is provided at a position close to the inner periphery side of the guide member 36. The jackpot selector 37 rotates in direction A or B in FIG. 3. Three jackpot pockets 38 are formed in the vicinity of the center of the jackpot selector 37. A protrusion 39 having a substantially-triangular cross-sectional profile is provided between the jackpot pockets 38.

Figure 8:
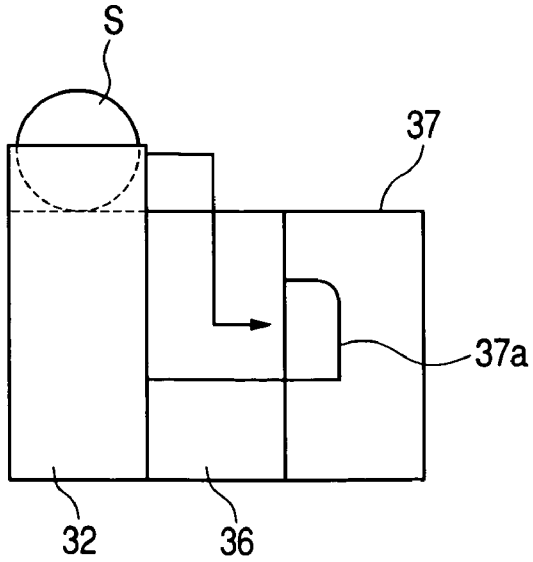
FIG. 8 is a cross-sectional view of the random number selector in the normal game state.

FIGS. 4 and 8 show a descended state of the guide member 36. When the ball has passed by the first passage 34, the ball falls into the inner periphery side of the roulette section 32. The ball S is then recovered by way of a recovery port 37*a* and supplied to the roulette section 32, thereby conducted a random number selection again. When the ball S passes by the first passage 34 in this state, "RETRY" is achieved.

Figure 9:
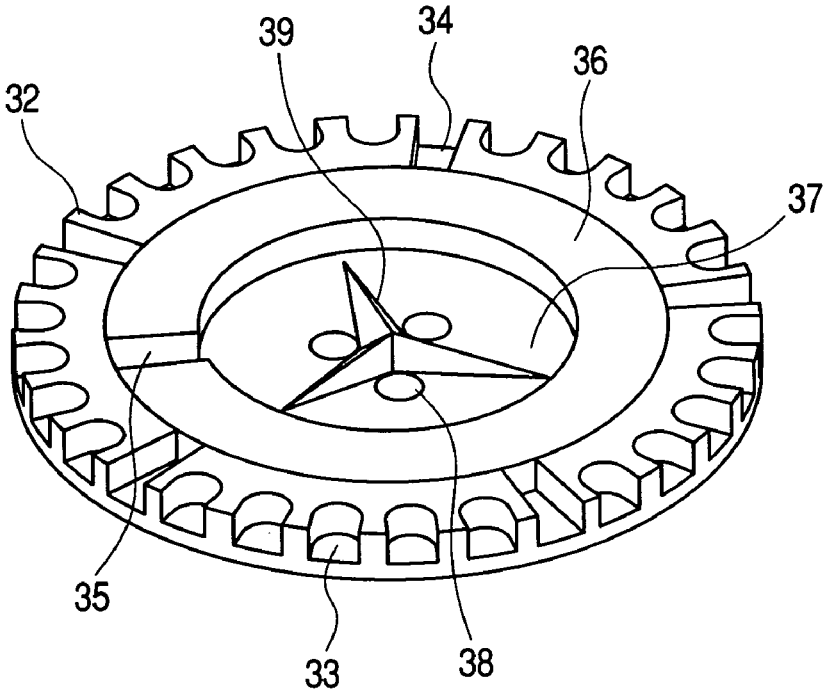
FIG. 9 is a perspective view showing the random number selector in a jackpot game state.
Figure 10:
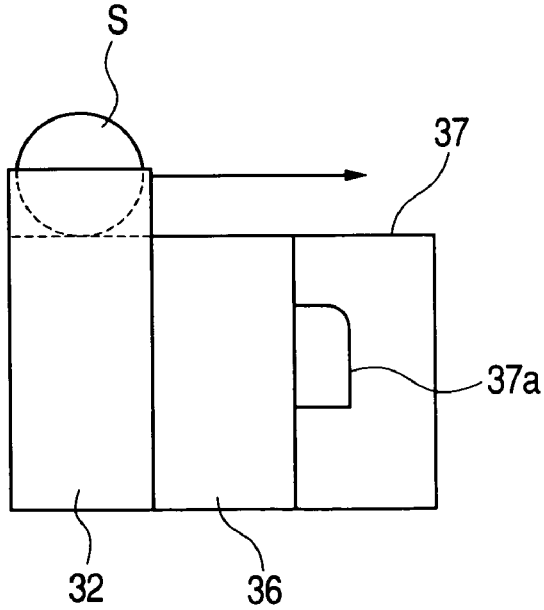
FIG. 10 is a cross-sectional view of the random number selector in the jackpot game state.

FIGS. 9 and 10 show an ascended state of the guide member 36. When the ball S has passed by the first passage 34, the ball S arrives at the jackpot selector 37 while passing through the second passage 35, whereby a jackpot selection is conducted. Sensors for detecting catch of the ball S are provided in the respective pockets 33. Further, the first passages 34 and the second passage 35 are provided with sensors for detecting passage of the ball S.

In the embodiment, a normal game and a jackpot game are performed. In the normal game, when a selection ball S has entered a numbered pocket 33, a corresponding number of a bingo card is made valid. When the ball has passed by the first passage 34, the ball is recovered. The ball is again used for lottery in the roulette section 32. In the normal game, when numbers that have been made valid as a result of random number selections are aligned in a vertical, horizontal, or diagonal row on the bingo card, a "BINGO" is hit.

When the ball has entered the numbered pocket so that the player's bingo card whose corresponding number is made valid has satisfied a certain requirement, an additional ball to be used for playing the jackpot game is provided. In the embodiment, the "certain requirement" means a win over a CPU player. Specifically, the certain requirement is that the CPU player has not yet hit a bingo but any of the players has hit a bingo while all the balls have entered the pockets, or that a bingo hit by any of the players is higher in level than that hit by the CPU player when the player and the CPU player have hit a bingo simultaneously. "Higher level" means that the number of lines constituted a bingo on the player's bingo card is greater than the number of lines constituted a bingo on the CPU player's bingo card. For instance, provided that one line has constituted a bingo on the CPU player's bingo card, when two or more rows have constituted a bingo, the player is determined to have hit a bingo which is higher in level than that hit by the CPU player. If the CPU player and the player have hit a bingo of the same level, either of the players may be determined to be a winner or a draw is provided, to thereby return the bets (i.e., gaming values bet by the players) to the players. In the embodiment, a draw makes the player a loser. Acquisition of a given amount of gaming valuables during the course of a given number of games may be adopted as the foregoing requirement.

In the jackpot game, when the ball S has entered a numbered pocket 33, a corresponding number of the bingo card is made valid. Further, when the ball S has passed by the first passage 34, the ball is guided to the jackpot selector 37 to be described later, where jackpot selection is conducted. If the ball S has entered any one of jackpot pockets 38 during jackpot selection, a dividend assigned to the jackpot pocket is afforded to the player.

In the embodiment, a bingo game is played while bingo cards of the respective players are displayed on the terminal displays 4*a* of the terminals 4 allocated to the respective players, while the bingo card of a virtual player of the computer (i.e., the CPU player) is displayed on the center display 2. Accordingly, the player can play a match against the virtual player in the bingo game. The player predicts, with an expectation, a number which would enable the player to hit a bingo earlier than the virtual player upon the random number selection, while comparing the state of his/her bingo card with that of the virtual player's bingo card. As a result, the player can play a bingo game having a new gaming characteristic, which cannot be achieved by the conventional bingo game machine.

Figure 11:
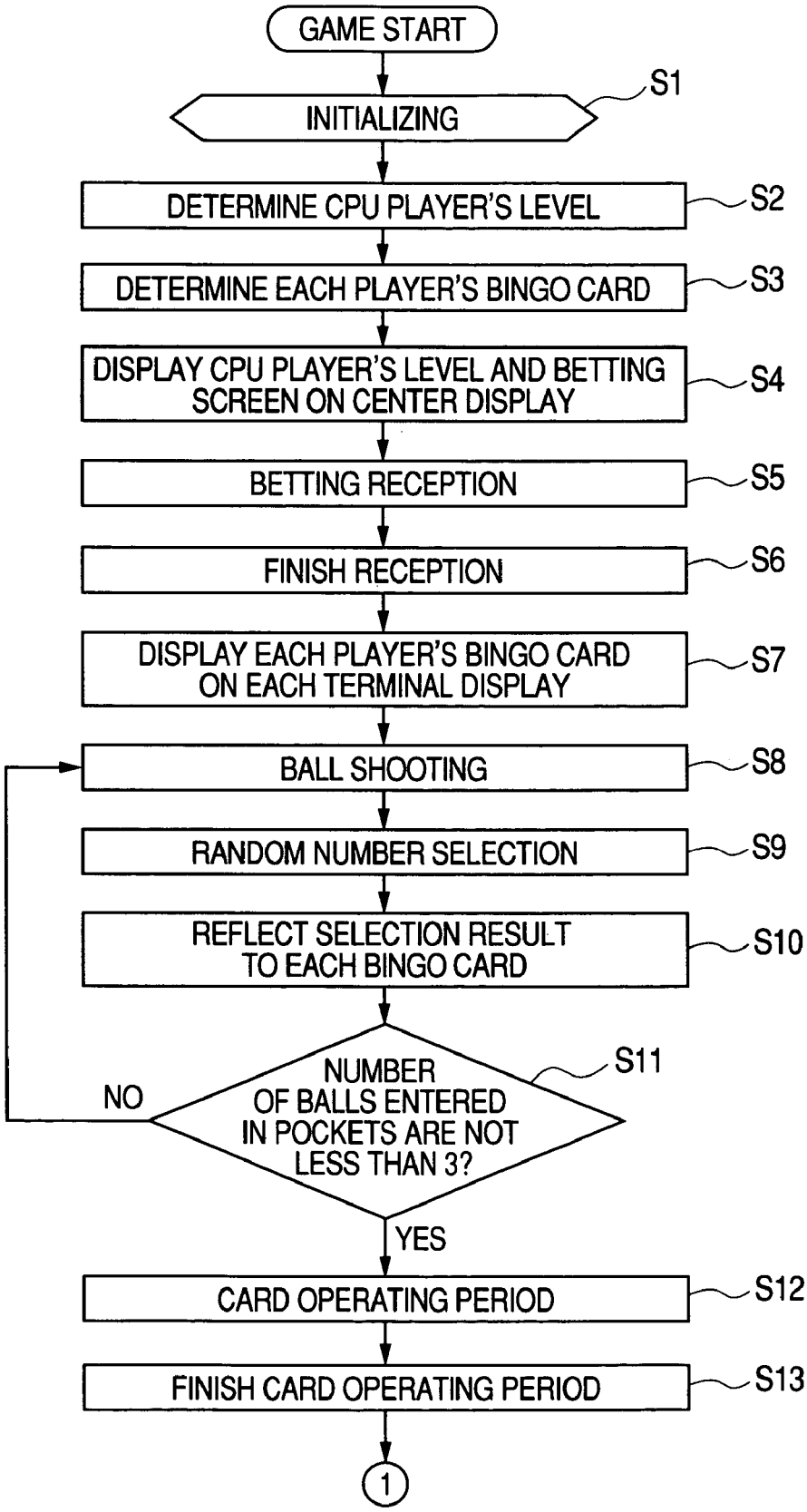
FIGS. 11 and 12 are flowcharts showing operation of the bingo game machine.
Figure 12:
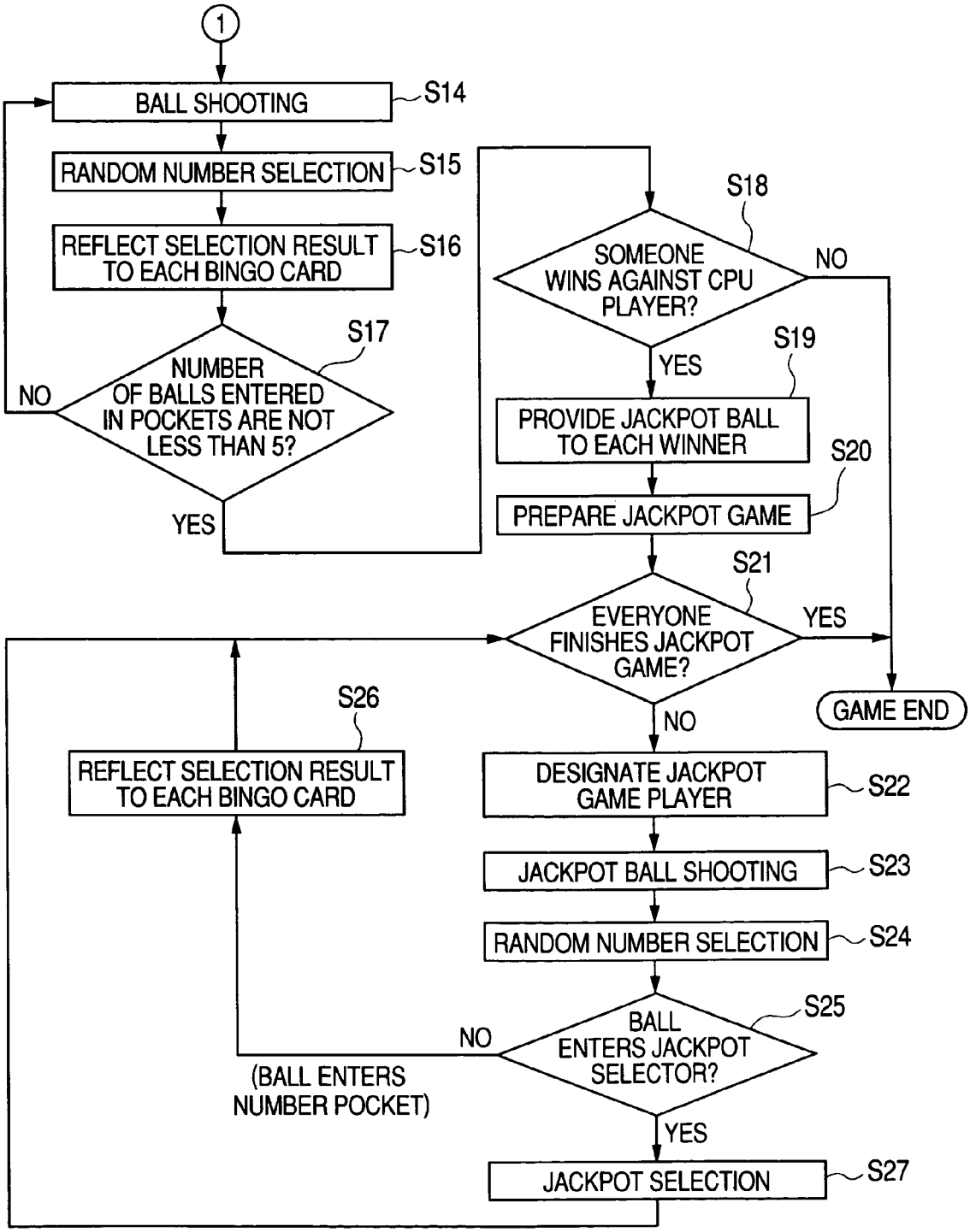

Next, operation of the bingo game machine having the foregoing construction will now be described by reference to FIGS. 11 and 12. First of all, the mechanism of the game machine is initialized (step S1). Specifically, since a normal game is to be played, the guide member 36 is lowered as shown in FIG. 4. Next, the level of the CPU player, who is a virtual player, is determined (step S2). The level of the CPU player is determined in, e.g., four levels. "The level" corresponds the number of lines sought by the virtual player when the virtual player plays a bingo card. For instance, the level of the virtual player is set to four levels A through D. In level A, a bingo card is operated with the aim of hitting a bingo in three lines (how to operate the bingo card will be described layer). In level B, the bingo card is operated with the aim of hitting a bingo in two lines. In level C, the bingo card is operated with the aim of hitting a bingo in only one line. In level D, the bingo card is operated at random regardless of establishment of a line. As a result, a characteristic of the virtual player is disclosed, odds are changed according to the characteristic, and the probability of occurrence of a bingo can also be changed.

Bingo cards of the respective players are now set (step S3). Here, the game levels of bingo cards for the respective players are determined from one game to another game. The game level of a bingo card of each player is determined by the position of a symbol "FREE" in the bingo card. For example, the upper left corner of a bingo card is defined as 1st row, 1st column. When the symbol "FREE" is situated at the center of the bingo card (i.e., 3rd row, 3rd column), the symbol "FREE" affects a total of four lines; that is, one vertical row, one horizontal row, and two diagonal rows. When the symbol "FREE" is situated at the upper left corner (1st row, 1st column), the symbol "FREE" affects a total of three lines; that is, one vertical row, one horizontal row, and one diagonal row. When the symbol "FREE" is situated at a position (1st row, 2nd column), the symbol "FREE" affects a total of two lines; that is, one vertical row and one horizontal row. The game levels of the bingo cards are determined by determining the positions of the symbols "FREE" in the bingo cards of the respective players. As a result, hitting of a bingo by the bingo cards of the respective players becomes easy or difficult. A change in the difficulty of a game gives a stimulus to the players at all times, whereby the payers can play bingo games without losing interest.

Figure 13:
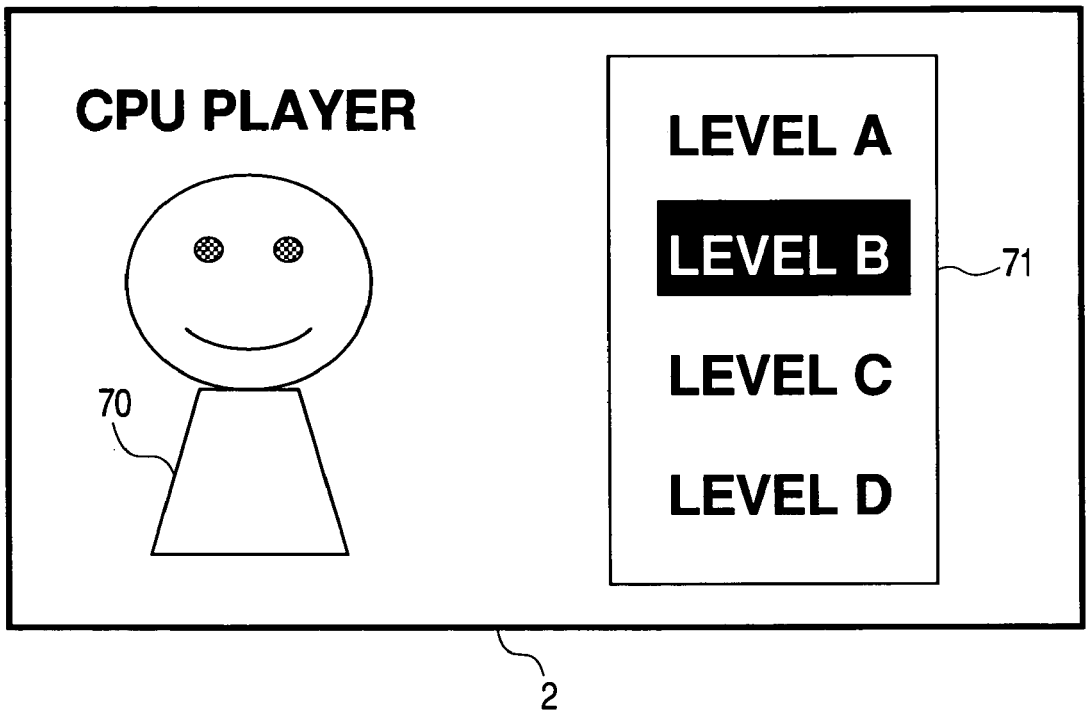
FIGS. 13 and 14 are views showing example images displayed on a center display of the bingo game machine.

Next, a betting screen and the level of the CPU player are displayed (step S4). For example, the level of the CPU player may be displayed as shown in FIG. 13. The center display 2 displays an image 70 of the CPU player and an image of the thus-determined level. In the embodiment, the levels are determined in four levels from A to D. The level of difficulty of the CPU player is set so as to become lower in descending order from A to D. Here, the level B is presumed to have been selected as shown in FIG. 13.

Figure 14:
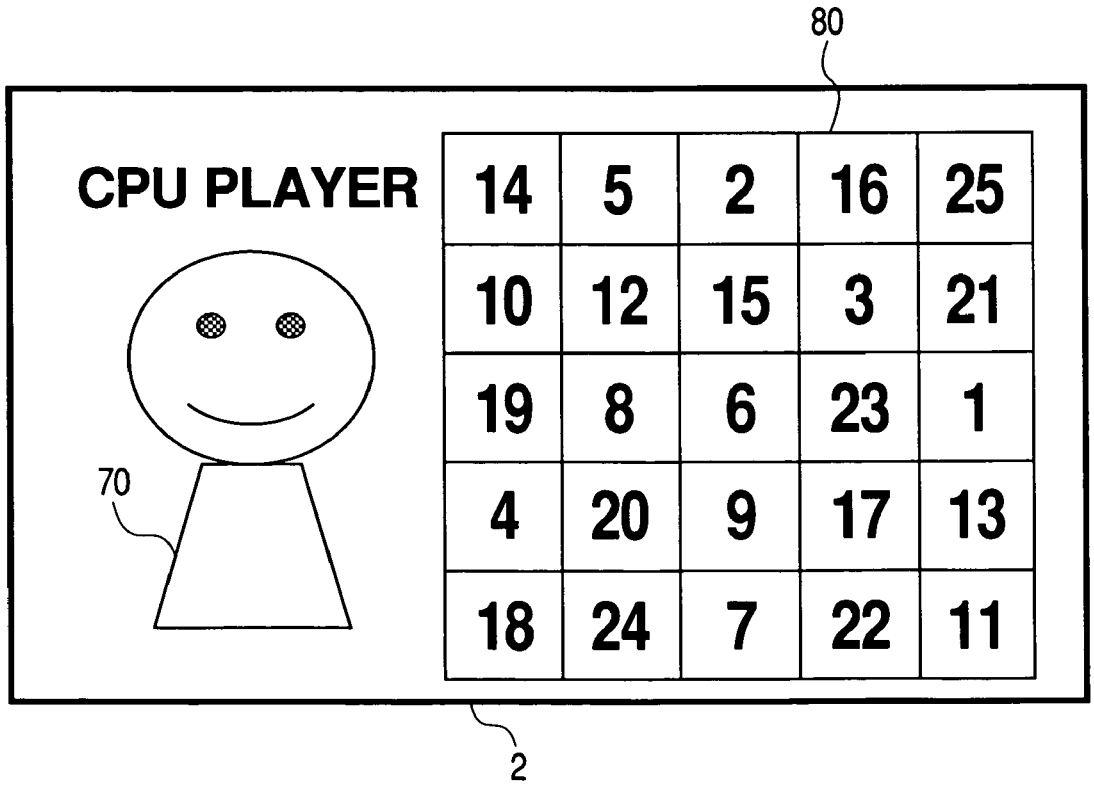

Next, the game machine awaits until a given time period lapses for receiving bets laid by the respective players (step S5). After lapse of a given time period, betting is closed (step S6). The bingo cards of the respective players are displayed on the terminal displays 4*a* of the player' terminals 4 (step S7). Here, as shown in FIG. 14, a bingo card 80 of the CPU player is displayed on the center display 2.

Next, a selection ball is shot in the random number selector 3 (step S8). For example, the number of balls used in lottery is five. The first three balls may be shot continuously, or the balls may be shot one by one; i.e., one ball is shot every time a symbol is determined. Then, the game machine awaits determination of a symbol (step S9). Specifically, the ball approaches the pockets 33 or the first passages 34 while rotating the field 31 in the random number selector 3. When the ball has entered any one of the pockets 33, the number of that pocket 33 is determined as a symbol. When the symbol has been determined, the thus-determined symbol is reflected on the bingo card of the CPU player and the bingo cards of the players (step S10). When the ball has passed by the first passage 34, since the guide member 36 remains descended, the ball drops into a space between the roulette section 32 and the jackpot selector 37 and is recovered by way of the recovery port 37*a*. A ball corresponding to the thus-recovered ball is again shot as "RETRY."

Next, a determination is made as to whether or not three balls have already entered the numbered pockets 33 (step S11). When the number of entered balls has not yet reached three, operation proceeds to step S8, where the above-described processing is iterated. In contrast, when the number of balls having entered the numbered pockets 33 has reached three, the game machine awaits until a given time period lapses for operating the layout of the numbers of the bingo cards (step S12).

Here, operation of the layout of the numbers of the bingo cards means that the layout of numbers on a bingo card is subjected to an interchange between rows or columns or leftward or rightward rotation one line at a time. For example, the numbers that have been made valid by lottery conducted by the random number selector are presumed to be 3, 7, and 19. Further, the bingo card has such a layout as that shown in FIG. 15. "STAR" provided on the card mean symbols "FREE" which remain valid from the beginning. In this case, numbers which have been made valid by interchanging the first column with the third column; that is, "STAR, 3, 19, STAR, 7" are aligned diagonally, to thereby hit a "BINGO."

Figure 15:
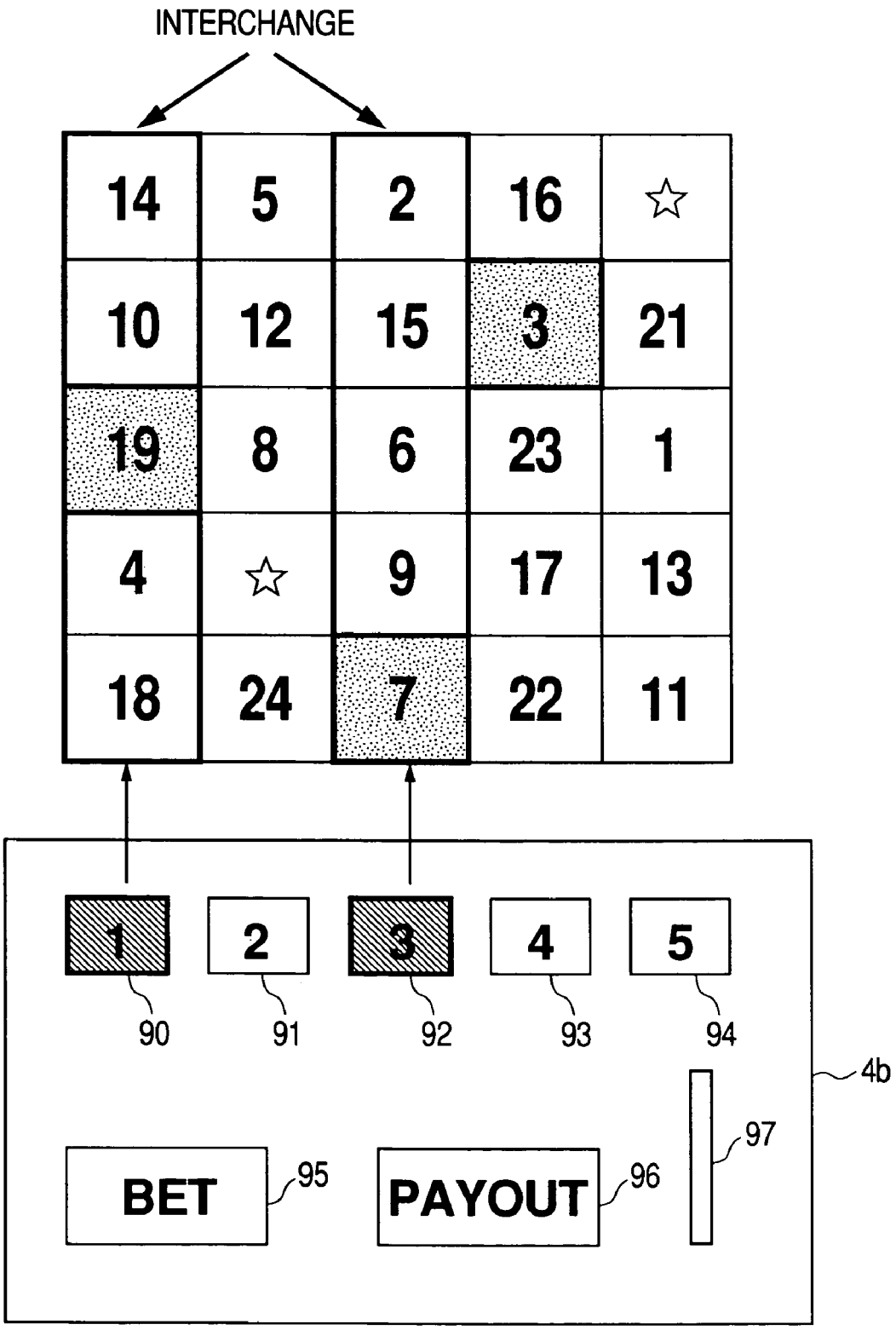
FIG. 15 is a view showing the way of interchanging columns in a bingo card displayed on a terminal display of the bingo game machine.

The operating section 4*b* has such a configuration as that shown in, e.g., FIG. 15. Specifically, the operating section 4*b* has a first column selection button 90 for selecting a first column in the bingo card; a second column selection button 91 for selecting a second column; a third column selection button 92 for selecting a third column; a fourth column selection button 93 for selecting a fourth column; and a fifth column selection button 94 for selecting a fifth column. The operating section 4*b* has a betting button 95 to be used for making a bet; a payout button 96 to be used for paying out a corresponding number of tokens from existing credits; and a slot 97 to be used for inserting a token. When playing the bingo card, the player actuates a button for selecting column to be interchanged. In this case, the first column selection button 90 is depressed. Next, a button for the column to be used for interchanging is actuated. In this case, the third column selection button 92 is pressed. In the bingo card, the first and third columns are interchanged. Specifically, the first column assumes numbers of 2, 15, 6, 9, 7 from the top. The third column assumes numbers of 14, 10, 19, 4, 18 from the top.

When the time period to be used for playing the bingo cards mentioned above has lapsed, card operating period is finished (step S13), thereby inhibiting operation for operating the card layout. Next, fourth and fifth balls are shot (step S14). Here, the fourth and fifth balls may be shot continuously, or the fifth ball may be shot after a symbol has been determined by the fourth ball. The game machine awaits determination of symbols (step S15). When the fourth ball approaches the pockets 33 or the first passages 34 while rotating around the field 31 and finally enters any one of the pockets 33, the number assigned to the pocket 33 is determined as a symbol. When the symbol has been determined, the thus-determined symbol is reflected on the bingo card of the CPU player and the bingo cards of the players (step S16). When the ball has passed by the first passages 34, the ball falls into the space between the roulette section 32 and the jackpot selector 37 and is recovered by way of the recovery port 37*a*. A ball corresponding to that ball is again shot as a "RETRY."

Next, a determination is made as to whether or not five balls have already entered the numbered pockets 33 (step S17). When the number of entered balls has not yet reached five, operation proceeds to step S14, where the above-described processing is iterated. In contrast, when the number of balls having entered the numbered pockets 33 has reached five, a determination is made as to whether or not any players have won over the CPU player (step S18).

If the result of determination rendered in step S18 shows that no player has won over the CPU player, the game will end. However, if there are players who have won over the CPU player, the number of winner players is counted, and the right to conduct jackpot selection is afforded to the players (step S19). Here, the jackpot selection is a lottery for ejecting a special jackpot ball over the field 31 and affording a dividend to the players according to the jackpot pocket 38 where the ball has entered.

The random number selector 3 makes preparations for conducting jackpot selection (step S20). Specifically, as shown in FIGS. 9 and 10, the guide member 36 is caused to ascend so that the ball S can pass by the second passage 35. Next, a determination is made as to whether or not a player has not yet conducted jackpot selection (step S21). Here, since preparations for starting jackpot selection are being made, there is no player who has not yet conducted jackpot selection. Players to be subjected to a jackpot selection are designated (step S22), balls for the designated players are shot (step S23), and the game machine awaits determination of symbols (step S24).

A determination is made as to whether or not the ball has passed by the first passage 34, which is a passage for jackpot selection (step S25). When the ball has entered any one of the pockets 33 rather than the first passage 34, a corresponding number is reflected on the bingo card of the CPU player and the bingo cards of the players (step S26). Operation proceeds to step S21.

When the ball has passed by the first passage 34, which is a passage for jackpot selection, the ball enters the second passage 35 while rotating along with the roulette section 32. When having passed by the second passage 35, the ball reaches the jackpot selector 37, where the game machine is brought into standby until any jackpot is hit (step S27). The ball moves in a manner that the player cannot predict on the jackpot selector 37 while getting over the protrusion 39. When the ball has entered any one of the jackpot pockets 38, a dividend corresponding to the thus-selected jackpot is afforded to the players. A conceivable dividend is an increase in the amount of credit by 100 tokens. When the jackpot has been determined through jackpot selection, operation proceeds to step S21. When there is any player who has not completed the jackpot selection, the foregoing operations are iterated. However, when there is no player who has not yet completed jackpot selection, the game ends.

As mentioned above, when there is a player who has won over the CPU player, a ball to be used for playing a jackpot game is offered to the player, whereby the player is given a chance for performing jackpot selection. During the jackpot game, when having passed by the first passages 34, the ball is guided to the jackpot selector 37 by the guide member 36, where jackpot selection is conducted. Therefore, during the jackpot game, the player who has been given the additional ball has a strong expectation for the ball passing by the first passage 34. As a result, a new bingo game which gives a strong stimulus to the interest and expectation of the player can be played.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

The invention claimed is:

1. A random number selector using a selection ball, comprising:

a first selector, provided with a passage and a plurality first pockets each associated with a symbol and operable to receive the selection ball;

a second selector, provided with a plurality of second pockets each associated with a jackpot and operable to receive the selection ball;

a guide member, which guides the selection ball which has been passed through the passage in the first selector to the second selector;

and wherein the guide member is vertically movable in a space between a first position operable to guide the selection ball which has been passed through the passage to the second selector and a second position operable to guide the selection ball which has been passed through the passage to a recovery port through which the selection ball is recovered to an initial position.

2. The random number selector as set forth in claim 1, wherein the first selector and the second selector are coaxially and horizontally arranged while defining a space therebetween in which the guide member is disposed.

3. The random number selector as set forth in claim 2, wherein the first selector and the second selector are rotatable independently.

4. The random number selector as set forth in claim 1, wherein the second selector is provided with a protrusion located between the second pockets.

5. A bingo game machine, comprising:

the random number selector as set forth in claim 1; and a controller, operable to perform a first bingo game using only the first selector, and a second bingo game using both of the first selector and the second selector.

6. The bingo game machine as set forth in claim 5, wherein the controller is operable to provide an additional selection ball used in the second bingo game to at least one player in a case where the at least one player satisfies a predetermined requirement in the first bingo game.

7. The bingo game machine as set forth in claim 6, wherein:

the controller is operable to control a virtual player who plays the first bingo game together with the at least one player; and the predetermined requirement is to win over the virtual player in the first bingo game.

8. The bingo game machine as set forth in claim 7, further comprising:

a first display, which displays a bingo card of the virtual player; and a plurality of second displays, each of which displays a bingo card of each player, wherein the second displays are located at viewpoints of the first display.

* * * * *